US009997150B2

(12) United States Patent
Krasnov

(10) Patent No.: US 9,997,150 B2
(45) Date of Patent: Jun. 12, 2018

(54) HUMBUCKER PICKUP DEVICE FOR ACTIVE AND PASSIVE GUITARS

(71) Applicant: Valerii Vladislavovich Krasnov, Murmansk (RU)

(72) Inventor: Valerii Vladislavovich Krasnov, Murmansk (RU)

( * ) Notice: Subject to any disclaimer, the term of this patent is extended or adjusted under 35 U.S.C. 154(b) by 0 days. days.

(21) Appl. No.: 15/491,042

(22) Filed: Apr. 19, 2017

(65) Prior Publication Data

US 2018/0122350 A1 May 3, 2018

Related U.S. Application Data

(63) Continuation of application No. 15/338,511, filed on Oct. 31, 2016, now Pat. No. 9,842,580.

(51) Int. Cl.
*G10H 3/18* (2006.01)

(52) U.S. Cl.
CPC ..... *G10H 3/181* (2013.01); *G10H 3/182* (2013.01); *G10H 3/186* (2013.01); *G10H 2220/515* (2013.01)

(58) Field of Classification Search
CPC ..... G10H 3/182; G10H 3/181; G10H 3/186; G10H 2220/515; G10H 2220/565
USPC ..... 84/726–728
See application file for complete search history.

(56) References Cited

U.S. PATENT DOCUMENTS 3,571,483 A * 3/1971 Davidson ..... G10H 3/181 84/726
4,220,069 A * 9/1980 Fender ..... G10H 3/182 84/726
4,283,982 A * 8/1981 Armstrong ..... G10H 3/182 84/728
5,189,241 A * 2/1993 Nakamura ..... G10H 3/181 84/728

(Continued)

OTHER PUBLICATIONS

Kolpakov, Vladimir: Sound pickups and their basic properties. A site Guitar.ru , Information for musicians, Russia, Apr. 10, 2003 [online], [retrieved on Feb. 21, 2011]. Retrieved from the Internet <URL: http://guitar.ru/articles/pickup/sound-pickup_317_html> indent 5 after Figure 8 with Side-by side Humbucker picture (calculation for humbucker tonal flaw).

(Continued)

*Primary Examiner* — Jeffrey Donels

(57) ABSTRACT

A humbucker pickup device for active and passive guitars including a matched pair of elongated coil assemblies with two sets of ferromagnetic pole pieces also includes two elongated, transversely polarized permanent magnets positioned between and parallel to the coils. The magnets are beside each other with opposite poles facing each other. The magnets with two respective pole pieces under each string establish two narrow magnetic fields to interact with the string at two points and a weaker intermediate magnetic field between the said pole pieces. The humbucker device includes an improved differential amplifier built from two or three operational amplifiers. Alternatively, the device may (Continued)

include a steel plate between the magnets for further weakening the intermediate magnetic field. Both embodiments, with and without the plate, are described.

14 Claims, 5 Drawing Sheets

(56) References Cited

U.S. PATENT DOCUMENTS

| | | | | |
|---|---|---|---|---|
| 5,399,802 | A * | 3/1995 | Blucher | G10H 3/181 84/726 |
| 5,525,750 | A | 6/1996 | Beller | |
| 5,908,998 | A * | 6/1999 | Blucher | G10H 3/181 84/723 |
| 2014/0318350 | A1* | 10/2014 | Krasnov | G10H 3/143 84/726 |
| 2015/0262568 | A1 | 9/2015 | Krasnov | |

OTHER PUBLICATIONS

EMG81 Pickup Analisis (ElectroSmash—Electronics for Audio Circuits) [online]. Godaddy.com, LLC, 2007 [retrieved on May 15, 2016]. Retrieved from the Internet <URL: http://www.electrosmash.com/emg81> point 2. EMG81 Schematic, indent 1, line 1. About filters and super bass harmonics, point 3. EMG-81 Frequency Response, indent 4. About methods of the improvement in tonal quility, point 4. Electronic Humbucker Unbalance, indent 3 and indent 5, line 2.

Instrumentation Amplifier (Wikipedia, the free encyclopedia) [online]. Wikimedia Foundation, Inc., 2016 [retrieved on Jan. 20, 2017]. Retrieved from the Internet <URL: https://en.wikipedia.org/wiki/Instrumentation_amplifier> line 6 after a formula (about clipping in the signal in differential amplifiers).

* cited by examiner

HUMBUCKER PICKUP DEVICE FOR ACTIVE AND PASSIVE GUITARS

CROSS-REFERENCE TO RELATED APPLICATION

This continuation application claims the benefit of U.S. patent application Ser. No. 15/338,511 filed Oct. 31, 2016, which is related to the following application:
Ser. No. 14/266,811 filed Apr. 30, 2014 is now abandoned;
Ser. No. 14/726,448 filed May 29, 2015 is now abandoned;
Provisional Application 61/817,695 filed Apr. 30, 2013, the contents of each of which are herein incorporated by reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFECE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

1. Field of the Invention

The present invention relates to electromagnetic pickups for guitars and, more particularly, to an improved humbucker device which is particularly useful in electric and bass electric guitars. The pickup may also be used for guitars or other stringed musical instruments as a passive humbucker without a preamplifier.

2. Background Art

One common and well-known flaw of conventional two-coil humbucker pickups (i.e. conventional humbuckers) is that conventional humbuckers cannot achieve the tonal characteristics in the guitar sound of conventional single-coil pickups. The sound of guitars with single-coil pickups is usually brighter and clearer than that of humbucker guitars. The main reason of that lies in the different widths of the magnetic fields from the pickups applied to the strings.

There is also another factor affecting the tonal properties of pickups. Having two coils and two row of pole pieces, i.e. two pole pieces for each string, humbuckers pick up the two signals from two points on the string which are mixed thereafter. Though these points are close to each other, yet their vibrations may have phase difference. As a result, there may always be some losses or distortions in frequencies with different phases after the two signals are mixed on the humbucker output. But in practice, phase differences in electric guitars manifest mainly when two pickups of different positions on a guitar (which are at a bigger distance from each other) are switched-on and the signals from these pickups are mixed. A well-known sonic defect, as a certain problem, manifests with two conventional humbuckers positioned in Neck and Bridge positions on guitar, when at the time of switching-on both humbuckers the brightness and clarity in the guitar sound become explicitly lesser than that with one switched-on humbucker. In practice at this moment guitar players are often forced to do the additional adjustment by means of guitar potentiometers to catch a new good tone. Some players even do not use this mixed mode.

As regards the types of pickups picking up the signal from one or two nearby points on the string, it appears that a magnetic factor, quite strong magnetic impact of the pickups on the ferromagnetic strings, is the main reason of the different tonal properties between these pickups, i.e. between conventional single-coil pickups and humbuckers. And this reason is the above difference in width of the magnetic fields.

Conventional single-coil pickups are narrower in width than conventional two-coil humbuckers approximately twice due to their single coil and one row of steel pole pieces. The upper end of each of these pole pieces is directed to a respective string. Unlike the wide humbuckers, thanks to one row of pole pieces, the single-coil pickups provide a narrower magnetic field applied to one small part of the vibrating string. Such magnetic field inhibits the string vibrations to a lesser extent. Thanks to this fact, the single-coil pickups provide enough a nice natural sound for electric guitars that allows these pickups, despite their bad noise immunity, to compete successfully with the humbuckers. The traditional single-coil pickups typically include a single magnet.

In turn, conventional humbuckers also include a single magnet, but as is said they have the two rows of pole pieces (see FIGS. 1, 1A) to provide two magnetic fields applied to two points on the string from two respective pole pieces extending to this string. But in fact, along the string between and out the said pole pieces there is one total and continuous magnetic field (see FIG. 1B, the distance A). An affected portion of the string from such a wide magnetic field is significantly larger than that an affected portion of the string for conventional single-coil pickups (compare with A in FIG. 2).). The interval between the said two pole pieces extending to the string is not large enough. And because of the opposite magnetic poles on these pole pieces, there arises an additional and strong magnetic field (9 in FIG. 1B) in this interval also applied to the string. As a result for humbuckers, the string vibrations are subjected to a large negative affect from the wide magnetic field, mainly, from the said additional branch 9, which, in turn, does not exist in single-coil pickups.

Knowing the width of a conventional humbucker, in particular, the interval between the two respective pole pieces (or the same, the length of the affected part of the string over these pole pieces), it is possible to estimate the damage in the harmonic spectrum of the humbucker output because of the said additional magnetic field in this interval. For conventional humbuckers this interval is equal usually about 18 mm (the interval D in FIG. 1B). Knowing the length of a vibrating string (about 648 mm for electric guitars) and based on the standard calculation of physics of the vibrating string it is possible to determine frequencies, wave-lengths of which (or half wave-length) become comparable with the said interval 18 mm. I.e., the frequencies starting from which the losses and distortions arise into the humbucker spectrum.

For example, for the sixth string, the note E (mi, 80 Hz), the half wave-length of this frequency corresponds to the said string length 648 mm. Then 648/18=36, i.e. the half wave-length of 36-th harmonic gets into this interval 18 mm on the affected string portion. In turn, the 36-th harmonic corresponds to the frequency 80×36=2880 Hz. This means that losses and distortions into the harmonic spectrum for conventional humbuckers may be already for frequencies from 2880 Hz and above. Indeed, the conventional humbuckers have a well-known failure around 3000 Hz into their amplitude-frequency characteristic for the sixth string. The frequencies around 3000 Hz are the same frequencies that provide the brightness and clarity in the guitar sound and what usually does not suffice with the humbuckers. The said calculation for the failure around 2880 Hz is shown in the article of Kolpakov "Sound pickups and their basic properties", published on Apr. 10, 2003. The article is hereby incorporated by reference into this application.

Describing the common tonal flaw of conventional humbuckers, the said article focuses mainly on two points of the string from where signals are picked up and, thus, have some phase difference noted above. Currently, the method of picking up the signal from the two points is considered as one of the main reasons of the tonal flaw of the humbuckers. And pickup developers often prefer to create double-coil pickups having one common row of pole pieces for both coils, i.e. one pole piece for string, assuming that the signal picked up from a single point on string incorporates far more harmonics in the output of the pickups. Document U.S. Pat. No. 6,846,981 describes one of the similar pickups with two coils wound around one row of pole pieces.

At the same time, in the prior art, there are many facts indicating that the magnetic influence of guitar pickups on the string vibrations is large enough and significant in the formation of the tonal properties of guitars with these pickups. For example, document U.S. Pat. No. 5,525,750 by Beller is a long ago known, issued Jun. 11, 1996, which describes a humbucker with a smaller aperture, i.e. with the small width of the magnetic field applied to the strings. The magnetic field aperture of that humbucker is approximately the same width as that in conventional single coil pickups. As is said in the patent, this result is very significant because it means that such pickup senses the vibration of only a very short length of string, just as did a single-coil pickup. I.e., such humbucker also provides more harmonics in the output.

Together with the aperture, the strength of the magnetic field around the string created by the pickup magnet and pole pieces plays also an important role. On the whole, there is no clear system in use of those or other magnets now. Rather, the materials of different magnetic forces (alnico 2, alnico 5, ceramic etc.) are chosen to highlight the individual tone of a pickup. Or, if strong magnets, there is provided a certain non-magnetic gap or spacing between the magnet and the ferromagnetic pole pieces to weaken the magnetic field of the pole pieces which are directly close to the string vibrations, thereby, a more pleasing tonal quality for pickups and the guitar sound can be achieved. This method is described in detail in U.S. Pat. No. 5,399,802 granted in 1995. This document is hereby incorporated by reference.

Over time it has become well known in the prior art that even by a small change in the strength of the magnetic field in which the strings vibrate it is possible to obtain different variations in the pickup tone. Using magnets of different materials and different force, aspiring to obtain the own individual signature sound, manufacturers have created big variety of guitar pickups. This brings, of course, a certain inconvenience for musicians in the choice of guitars and pickups. Moreover, electromagnetic efficiency of passive pickups with a weakened magnetic field is considerably reduced that leads to the weakened output voltage. And many pickups suffer from this disadvantage. In turn, manufacturers of active pickups typically prefer to use weak magnets so to avoid too big impact of the magnetic field on the strings. And a weak initial signal from the coils, at the same time, is amplified to the needed value by a preamplifier which is mounted into the pickups.

Thus, although some phase difference in the signals from the two nearby points on the string may present in conventional humbuckers, it should be understood by those skilled in the art that the role of this difference cannot be large for the tonal properties of the humbuckers. At least, the effect from the said phase difference cannot be estimated correctly if around the same points on the string and in the interval between them there is another strong factor as the magnetic impact of the humbuckers on this string part between the said points. As mentioned, this impact arises mainly from the widest and strong branch of the magnetic field of the humbuckers which is between the two rows, or for each string between the two respective pole pieces in the interval D equal 18 mm.

With that said, the above calculation for the tonal flaw of conventional humbuckers (losses since 2880 Hz) may quite be interpreted and explained from the point of view of the said negative magnetic impact. I.e. from the point of view of the magnetic field force and aperture of the humbuckers applied to the string part being over the respective two pole pieces with the interval 18 mm between them. Then for single-coil pickups, given that they and their magnetic field aperture is about twice narrower (see A in FIGS. 2 and 1B), an analogic calculation shows that losses and distortions for them may be in frequencies from 2×2880=5760 Hz and above, that is a little better. In reality the magnetic field aperture of the conventional humbuckers is a bit wider than it was accepted in the calculations. I.e. losses into the harmonic spectrum of the pickups may start from even lower frequencies than 2880 or 5760 Hz.

There have been attempts from various inventors and pickup manufacturers to eliminate the flaw of the humbuckers and to get more uniform harmonic spectrum like that in single-coil pickups. One of the attempts, for example, is the pickup known as a Side-by-side humbucker. In fact, this is a narrow humbucker with special narrow coils. The affected string portion from the magnetic field of such narrow pickups become less, however, this is only a partial solution of the problem. Two points on the string, from where the vibrations are picked up, are also close to each other and, as before, the string portion between them is in the zone of the strong intermediate magnetic field. The Side-by-side humbucker did not meet high expectations, it has a peculiar tone. And its total magnetic field aperture is even a bit wider than that in the single-coil pickups.

Another humbucker version, a Hum-canceller pickup known as double-coil pickup, is compacted into the size of a single coil. The Hum-canceller also has two windings for noise immunity, but the windings have one common row of pole pieces similarly as in the pickup of U.S. Pat. No. 6,846,981 noted above. Thus, the useful signal of the Hum-canceller is picked up from a single point on the string. And its magnetic field aperture is in fact the same as in the single-coil pickups. This is one of the most successful passive pickups, which unites together the useful properties of humbuckers and single-coil pickups.

Comparative examples for the apertures of single-coil pickup, conventional humbucker and narrow humbucker can be found in the above Beller U.S. Pat. No. 5,525,750 (see FIGS. 1, 2 and 3 for the prior art in this document). This patent is hereby incorporated by reference into this application.

However, conventional wide humbuckers retained their positions. For many guitarists the tone of a wide humbucker, similarly as in FIG. 1 with the interval D=18-20 mm, is well familiar and popular to this day. Some humbuckers, even of the oldest models, together with the corresponding guitars have established certain guitar sound standards what is known now as their signature sound. In fact now, as before, the conventional humbuckers and single-coil pickups have the demand in roughly equal measure. A certain role is played here by special guitar equipment.

Now the term Guitar Equipment means usually that it is intended for electric (or bass-electric) guitars. Other audio devices, amplifiers and loudspeakers for vocals or acoustic guitar, or typical Hi-Fi amplifiers etc., it is considered that such wideband equipment is not suitable for the electric guitars. Indeed, the guitar equipment, combo amp cabinets, i.e. guitar amplifiers and especially special loudspeakers have a specific narrow frequency range roughly up to 5000-6000 Hz or even less. In particular, this helps to disguise the flaws of the pickups, for example, the losses and the distortions of the humbuckers around 3000 Hz and above.

The guitar equipment is also various. Because of the big variety in the pickups, equipment and guitars, to catch a good tone, it is quite a difficult task for even accomplished musicians. Guitar players often spend a lot of time to find a successful combination between guitars, pickups and the guitar equipment. A known phenomenon GAS (Guitar Acquisition Syndrome), when having replaced a guitar and gear, after a while the guitar players again buy new guitars and the equipment, and professional guitarists take with themselves on a concert sometimes up to 10-15 different guitars including acoustic one.

Generally speaking, earlier guitarists had a wide choice in the guitar equipment when they worked in record studios and to find a good guitar tone, thus, it was not a too big problem. Now record and processing are to a great extent carried out on computers and often at home studios directly by guitarists, professional and usual players. Given that it is difficult to keep and to use at home the traditional sets of amplifiers and loudspeaker cabinets, the problem to find the good guitar sound has become particularly urgent. As such, the shortcomings of the passive pickups have become a serious obstacle for new studios computer-based. All understood, manufacturers and musicians, that electric guitar should be connected to a computer in a simpler way, without the use of traditional combo amp cabinets and microphones.

In this regard, certain companies have developed digital guitars and special pickups for these guitars. As a rule, such guitars include special digital guitar processing circuits and an additional digital output to be also compatible with a digital communication protocol for digital audio signals in connection with a computer (see, for example, U.S. Pat. No. 7,166,794). I.e., these guitars do not require traditional combo amp cabinets and microphones for recording. The signal in the guitars is already in the digital field, thus, the work of guitarist at his home studio computer-based can be considerably simplified.

The digital guitars include also conventional passive pickups, the analog signals of which are converted into digital signals for further communication to the digital output. It is intended that these digital signals will not return to an analog field and will not be corrected by the traditional combo cabinets. Therefore, to correct the tonal flaws of those pickups, in particular, humbuckers, the digital guitars comprise special filters and equalizers. Today such guitars are pretty expensive musical instruments.

Other companies have chosen simpler way to improve conventional analog guitar without any digital circuits and additional complexity inside the guitar. Such companies, as mentioned, are manufacturers of active pickups. The active pickups are like wide humbuckers, but they additionally comprise preamplifiers (preamp) which are built on well-known circuits, known as differential amplifiers. Such amplifiers can use two differential inputs, inverting and noninverting terminals at connection with a source. By virtue of the two inputs, a balanced input mode can be provided when the inputs are connected respectively to two identical (or similar) coils of a humbucker. Besides signal doubling and hum-canceling, this mode is also known for one more feature to improve the sound. The sound in the balanced mode is as more voluminous and with high resolution in fine details. This feature is well-known to manufacturers of Hi-Fi, High-End and studio devices. But to establish the balanced mode with two respective signal chains, it is a rather complicated technical task for those devices, so, they are expensive. In turn for two-coil pickups, this task is much easier. Here the differential amplifiers are usually mounted into the humbucker cases, and such humbucker devices are typically called as active pickups or active humbuckers.

The standard unbalanced output of differential amplifiers may be easy connected to any volume-tone section inside an electric guitar, for example, to a volume potentiometer or to the switch of pickups depending on the model of the guitar. Interest in these amplifiers is also explained by the fact that they are successfully used in the mentioned professional studio and audio devices, in particular, such as microphone preamps, mixer consoles and others, where the amplifiers with the balanced mode provide a full-fledged and noiseless analog audio signal. It should also be noted that the prestige studio devices and equipment use mainly improved differential amplifiers known as instrumentation amplifiers built from two or three operational amplifiers.

However, in regards to guitar pickups, there are serious problems. All known methods of connecting conventional pickups to preamps including differential amplifiers cause significant difficulties. These difficulties occur, in particular, due to the values of the conventional pickup's electrical parameters, mainly, resistance and inductance which are too large. There arises a system of a pickup and a preamp as a Low-Pass filter (LP filter) having too low the cut-off frequency about from 300 up to 1000 Hz depending on the pickup model. This is certainly not acceptable for the good guitar sound. Although, this problem can be resolved by using additional resistors before the inputs of the preamp if here a simple differential amplifier is used. Or, even better for guitar, if as the preamp is used one of the above instrumentation amplifiers. The instrumentation amplifiers have excellent high input impedance and do not require the additional resistors, also they are not complicated. But there is another problem, obviously the most difficult, which is directly related to the described flaws of conventional pickups as regards their negative magnetic effect to the strings and too big losses and distortions in the output of the pickups.

In the prior art is known that differential amplifiers with the balanced mode are a powerful tool to maintain small audio signals and even, as mentioned, to improve the signal and sound. But this is true only if the signals have not obvious defects. For example, acoustic guitar, same 6-strings guitar but without magnetic pickups, has a natural (undistorted) range from 80 Hz up to 10,000 Hz and more, i.e. big enough. And this guitar does not require any special correcting means. As a result, acoustic guitar is without problems used with any wideband equipment and devices.

In the case of electric guitar the defects of magnetic pickups, the above described tonal flaws, are too extensive and noticeable. In accordance with the above calculations, the undistorted ranges of the pickups are too small only up to 2880 Hz (humbuckers) and up to 5760 Hz (single-coil pickups). It should be understood by those skilled in the art that such ranges, especially for humbuckers predominantly in the lower field, are decidedly unsatisfactory. And in practice, the sound of electric guitars with conventional pickups often has some excess of the low frequencies despite the special guitar equipment. Sometimes this excess can be corrected by means of effects boxes. But if the conventional pickups are directly used with differential amplifiers as active pickups, their tonal flaws and the said low excess will become too emphasized and obvious especially when the balanced input mode is used. In this case any guitar can lose its beautiful, individual tone. In simplest terms, instead of improving the tonal properties of the pickups, the differential amplifiers, vice-versa, make these properties even worse than they were in the passive mode.

The tone degradation can be so large that it can't be corrected by means of the guitar equipment or the effects boxes. This resulted to what now the conventional pickups, because of their strong magnets and high-impedance coils, in fact are not used with the differential amplifiers. Some special cases of such use are of course possible, in particular, for single-coil pickups, to do these pickups as active ones. But anyway, in those cases additional filters or equalizers are required, built-in into the body of guitar or pickup, thereby, increasing the complexity in design and in general this is little effective for the guitar sound.

Therefore, the companies that manufacture active humbuckers usually use weaker magnets and also make special coils of copper wire with a smaller number of turns (lesser resistance and inductance) to increase the cut-off frequency of the above LP filter in the system of humbucker and its preamp. However among musicians, the active pickups are of limited use. Despite the amplified signal by the preamp, guitar players often do not like the sound of these pickups and any other sound produced from coils with a too small number of turns and weak magnets. Such sound is described as plastic, "no brisk", or not natural enough. Moreover, there is a tendency among guitarists to use passive pickups with a large number of turns per coil, larger than that in conventional pickups. For example, passive single-coil P-90 pickups have up to 10,000 turns of wire instead of 7000-8000 as that typically in other versions of single-coil pickups. Despite the bad noise immunity the P-90 pickups are pretty popular thanks to their rich and saturated sound.

The said problems of active pickups became acute with the advent of studios, in particular, home studios computer-based and new digital technologies in record and processing. The active pickups would be particularly useful in such studios to avoid the use of the inconvenient guitar equipment, but the active pickups through the preamp are badly compatible with the high-impedance coils and strong magnets, thus, using weaker magnets and lower-impedance coils. On the other hand, guitar players cannot normally use pickups with low-power coils (with a small number of turns) and weak magnets giving a weak initial signal from the coils. Such pickups poorly transmit the play-manner and the individual features of guitars. Although the active pickups provide the amplified signal and a steady guitar tone, but, as mentioned, this is a stably "no brisk" tone, and all guitars including the most expensive become similar in sound. Most of guitarists eventually prefer conventional passive pickups with which the players feel themselves more comfortable due to the bigger signal from the coils, thus to better express their style and manner.

The modern conventional (passive) humbucker typically have between 6,000 and 7,000 turns of wire per coil. Single-coil pickups typically have more, as said, up to 10,000 turns. More detail data, in particular, on single-coil pickups, can be found in U.S. Pat. No. 7,022,909, issued in 2006. In turn, active humbuckers may have the number of turns in the two-three times less than the passive pickups. Some of the active humbuckers can reach up to 5,500 turns of wire per coil.

To correct the humbucker tonal flaw and to avoid amplifying the above excess of low frequencies the active humbuckers typically include filters before the inputs of the preamp. A leading example is the well-known EMG81 active humbucker manufactured by the company EMG Inc. As the filters this humbucker includes two coupling capacitors of 22n before its preamp providing a high pass filter with the cutoff frequency 241 Hz. Also, the filter additionally remove hum because the EMG81 uses some unbalancing the differential amplifier to get and to amplify a wider spectrum of frequencies. More detailed information about the EMG81 pickup may be accessed at the following web address, http://www.electrosmash.com/emg81. It may be noted that the EMG81 active circuit is the above simple differential amplifier built from one operational amplifier. Now such classic circuit is typically used in many active pickups. A certain limitation is that the EMG81 is recommended for use in Bridge position on guitar where the level of low frequencies is always less.

Thus, active pickups do not improve the guitar tone, as it should be, a rather here the string signal is subjected to a double negative impact. At first, this is the magnetic effect from the pickups on the string vibrations, and second, cutting the coil signal by the said filter of the preamp. Also third, the coil signal is not rather strong because of weaker magnets and a small number of turns that affects musician's play. In turn in passive pickups, the latter two drawbacks do not exist. Herewith, despite the much bigger number of turns (i.e. the bigger losses in the high and high-middle frequencies) the passive pickups or guitars with them don't comprise any coupling capacitors and no the need to filter super bass frequencies by such way.

It is also known in the prior art that increasing the number of turns in coil (or increasing the pickup's inductance) eliminates or reduces a harshness in the sound of electric guitars particularly evident at higher pitches. To increase the inductance without a corresponding increased resistance, passive pickups may include additional ferromagnetic materials as described in U.S. Pat. No. 5,908,998 by Blucher et al. In this aspect for active pickups, to avoid any additional materials, the above instrumentation amplifiers would be particularly useful if the active pickups used coils with a bigger number of turns, i.e. coils as in passive conventional pickups. Having high input impedance, these amplifiers are perfectly compatible with the conventional coils with any big number of turns and resistance. The said document is hereby incorporated by reference.

I.e., the instrumentation amplifiers and conventional coils would make certain simplification in method of constructing an active pickup and electric guitar to minimize manufacturing labor and material costs. A benefit of these amplifiers is also that they boost the gain using a single resistor that may be conveniently for any guitar with two (and more) pickups. As is known, the string signal in Bridge position on guitar is weaker than in Neck. Therefore in passive guitars (with passive pickups), to level the signals from Bridge and Neck pickups relative to each other, Bridge pickups should have coils, as a rule, with a bigger number of turns. To a certain degree this increases manufacturing labor for the passive guitars with several pickups. In turn with active pickups, it should be understood that if they used the instrumentation amplifiers there would be no need to follow the strict proportion to the number of turns between Neck and Bridge pickups. Here it is enough to select an appropriate gain-resistor, for example, in the preamp of Bridge pickup, and all other components for Neck and Bridge pickups including coils may be the same.

There are also complaints from musicians about that active pickups may suffer from an increased noise or may produce clipping in the signal. Certain noise, thermal noise from electronic components, is possible if initial signal is too weak due to low-power coils and weak magnets that compel to increase the gain in the preamp up to 4-5 typically. There are special active pickups with components of more higher-quality, low-noise and more fine-tuning. Some pickup manufacturers specialize in this field, but such pickups are quite expensive. As for clipping in the signal, it may manifest as a click in sound, some musicians even use it in heavy metal and rock music as the familiar distortion in the amplified sound. Yet, this is not always acceptable, the guitarist's game may be unpredictable and the signal from the strings may be quite large. In this aspect the instrumentation amplifiers also are more preferable than the simple differential amplifier from one operational amplifier. It is known in the art that the instrumentation amplifiers from two or three operational amplifiers can handle much larger common-mode signals without clipping (see the information, for example, in the website https://en.wikipedia.org/wiki/Instrumentation_amplifier).

But because of the described problems of the active pickups not using conventional coils with high impedances, the instrumentation amplifiers become ineffective. Now the active pickups usually include the simple differential amplifier that is also a certain drawback for them. To improve tonal qualities of these pickups using balanced inputs, modern manufacturers like EMG found the way to make both humbucker coils mechanically equal but unbalance them electronically, i.e. by winding the coils with the same number of turns but with wire of different gauge, diameter, material etc., thus, with different impedances. This provides a wider spectrum of frequencies similarly as from unbalancing the differential amplifier in the EMG81 pickup (noted above), but without losing the hum cancellation tendency. Similar tricks with coils are also used in passive humbuckers as described, for example, in U.S. Pat. No. 4,501,185 granted in 1985.

Thus, although advancements in pickup technology are present for both passive and active humbuckers, their problems described above continue to stay unresolved. As it appears, the principal reason of the problems is covered in the magnetic system of these pickups that for many years is unchanged. With any versions said system, as a rule, uses one magnet positioned between two rows of steel pole pieces. Or there may be magnets extending through coil assemblies instead of pole pieces. In anyway, the configuration and concentration of the magnetic field applied to a certain string part remain on the whole unchanged along this part. Active pickups have appeared much later than the passive and they just took in use the traditional single magnet, and manufacturers focused the principal attention on the preamp. The use of a weaker magnet cardinally changed nothing. In this case the magnetic field aperture remains the same wide, along which just the magnetic field is equally weakened. Then here other, the problem of a weak original (initial) signal is added, that was discussed above. Thus, it becomes evident that solving the problems and the further progress in pickups, particularly in the active ones, is impossible with the said magnet systems.

As a solution to this problem, there has been proposed a humbucker pickup device as disclosed in unexamined U.S. patent application Ser. No. 14/726,448 filed 29 May 2015, noted above, published as U.S. 2015/0262568, which has a humbucker pickup including a system of two magnets and provided with a preamplifier that processes the output signal of the pickup, thus cancelling noise. The said magnetic system consists of two similar and attracted magnets (by opposite poles) with the total width like the width of a single magnet in conventional humbuckers. Accordingly, with conventional coils placed closely in parallel, the humbucker device has the same width as a conventional humbucker, and both magnets as a whole are positioned in the same place similarly a single magnet in the conventional humbuckers, i.e. parallel to the coils and between lower ends of pole pieces of the different coils.

Humbucker devices including the said two-magnet system have been made by me and tested on various electric guitars for several years. As it was revealed, thanks to this magnetic system and the preamp, the novel humbucker device has got the advantages of both passive and active pickups. In particular in the active mode, unlike conventional active pickups, the device can easily include conventional high impedance coils and modern strong magnets, herewith, providing a full-fledged guitar signal and tonal quality not requiring any additional means of correction.

SUMMARY OF THE INVENTION

The main find in this invention, as mentioned, is to put two, more narrow permanent magnets instead of one into a conventional humbucker pickup in same place, wherein a single, wider magnet was before, i.e. between and parallel to two humbucker coils. Accordingly, the new magnets in sum are of the same width as the previous wide magnet. And as the previous, both magnets are transversely polarized magnets. Second, the humbucker thus updated is provided with a preamplifier (preamp). Inside the updated humbucker the magnets are attracted and abutted to each other by sides with opposite poles. Two other, north pole side of one magnet and south pole side of the other adjoin to steel pole pieces of both of the coils inducing on pole pieces of the different rows and coils the opposite poles as that in any conventional humbucker. So as described, the invention provides a novel electromagnetic device referred to hereinafter as a humbucker pickup device for active and passive guitars.

The said two magnets should be about equal in magnetic force and dimensions. Creating a magnetic field in general similar, as in conventional humbuckers, the two-magnet system maintains, at least does not weaken, outer magnetic branches (3 and 4 in FIG. 3B) of a respective pair of pole pieces for each string, but weakens an intermediate magnetic branch (9 in FIG. 3B) between these pole pieces. Weakening the widest intermediate branch leads to that the outer narrow branches 3 and 4, remaining strong, become more responsible, rather as the main magnetic branches interacting with the string. Herewith, their magnetic field apertures are small and lesser even than that in single-coils pickups (compare A in FIGS. 2 and 3B). The string part between these apertures, being over the weakened magnetic branch, is thereby freer in its vibrations. In turn, the said string part in fact is identical to the same part equal 18 mm, where, as calculated above, losses and distortions since 2880 Hz exist in conventional humbuckers with a single magnet. Thus, the humbucker device having the weakened magnetic branch is more protected from those losses and distortions.

In the methods of the improvement of tonal quality by weaker magnets or a certain space between the magnet and the pole pieces, as described in the Blucher U.S. Pat. No. 5,399,802 noted above, there the magnetic field of a humbucker is weakened on the whole including the outer narrow branches. Whereby, the electromagnetic efficiency of the pickup becomes less. The two-magnet system of the present invention provides the weakening only for the widest (undesirable) part 9 of the magnetic field. As a result, variation in the humbucker device tone due to the two magnets becomes crucial, particularly evident in the active mode with the preamp. Having the improved string signal, in this mode the device provides a pleasing natural guitar tone which, unlike conventional active pickups, does not require correction by means of filters, weak magnets or low-impedance coils.

Thus in an exemplary embodiment of the present invention, the said two-magnet system includes two usual strong magnets, for example, ceramic, and two conventional elongated pickup coils which may be with any big number of turns (remaining as a matched pair). Thereby, the humbucker device maintains high electromagnetic efficiency and the problems of active pickups associated with a weak initial signal, poorly transmitting the musician style and guitar features, are overcome. Also the problems associated with inadequate noise/signal ratio (thermal noise) and precision preamp components are overcome. With the adequate signal level the components may be conventional and inexpensive.

The humbucker pickup may be provided with the preamp integrally as into one common shielded case similarly as active EMG pickups. As well a second variant, thanks to the said adequate signal level from the coils, the preamp may be established separately into the volume section of a guitar without the need for pickup shielding.

With a glance to the magnetic field aperture of the humbucker device, it can be estimated the undistorted frequency range for the device. If the magnetic field aperture of the device is twice less than an aperture in single-coil pickups (see A in FIGS. 3B and 2) for which, as calculated, the undistorted range is about 5760 Hz, then by a similar calculation, the undistorted range for the device will be up to 2×5760=11520 Hz, i.e. almost as in acoustic guitar. Thus as regards tonal quality, it should be understood by those skilled in the art that for the present invention the magnet material do not really matter, and the magnets, being identical in force and dimensions, may be of any big force without affecting tonal quality.

An advantage of the said conventional coils with high impedances is that they allow the humbucker device to use effectively instrumentation amplifiers having higher input impedances than the simple differential amplifier. These amplifiers convey more accurately the improved string/coil signal enriched by high-middle frequencies & new harmonics. Also with the instrumentation amplifiers, the problem of clipping in the signal of the preamp is overcome, or at least significantly decreases.

A benefit of the instrumentation amplifiers is also that they allow two (or more) humbucker devices on a guitar to be identical or similar in preamp and pickup components including coils, for example, in components of the devices in Neck and Bridge positions. As mentioned, in this case to level the signals from the devices, it is enough to provide one difference between respective gain-resistors in the preamps of these devices. This can improve and simplify the method of constructing an electric guitar, in particular, to minimize manufacturing labor and to simplify assembly of components in active guitars and active pickups.

An alternate embodiment of the present invention provides a humbucker pickup device for active and passive guitars having the same design and the same components as the exemplary embodiment described above. An additional component is a steel plate of the length, at least not less than the length of the magnets, positioned between the magnets. Like the pole pieces, the plate is directed to the strings where its upper edge may be induced in some degree by the weakened intermediate magnetic branch between pole pieces of the different coils. Being in the middle between these pole pieces (and between the coils) the plate can additionally weaken the said magnetic branch beneath each string. The weakening occurs so, that this branch (9 in FIG. 4B) is distorted by the plate and else more localized beneath the strings away from their vibration zone. For a tangible effect, the upper edge of the plate should be roughly at the same distance from the strings as the upper ends of pole pieces.

The alternate embodiment provides generally a similar tone as the exemplary embodiment, but both embodiments can be useful on a guitar as a kit-pair to reduce the known sonic defect occurring with mixing the signals from two pickups on guitar described above. For the classic two-humbucker guitar with Neck and Bridge pickup positions, both humbucker devices (one with the plate) can provide in the mixed mode a new sound without noticeable sonic defect, but with its own enriched tone that appears at once at the time of switching to the mixed mode without any additional adjustment of guitar potentiometers.

The described effect is achieved due to that the plate, influencing on a wide intermediate magnetic branch either in Neck or Bridge position, thus, changes in some degree one of the pickups signals. It has been found that by means of the said small difference in construction due to the plate, the improved tonal quality may be achieved in the mixed mode on guitar as described above. In the methods for improving tonal qualities of a conventional humbucker noted above, there is required the difference in coils impedance from different wire diameter or unbalancing the differential preamp in active humbuckers. The Neck and Bridge humbucker devices of the said kit-pair, differing by the plate, may be identical or similar in coils, magnets and preamps without unbalancing the preamps.

Both embodiments of the invention are versatile pickups which may be also used in the passive mode without the preamps. The tonal humbucker-flaw of the invention is much lesser than in conventional humbuckers and the use of the invention as a passive version, for example, in digital guitars, probably can simplify the means of correction for conventional humbuckers used in those guitars. Or perhaps, the invention can facilitate the task for guitarists in search of a good tone with different guitar equipment. However with the preamp, the effect of the invention is more significant, and the passive mode, in fact, is not topical for the present invention. For example in the active mode, an electric guitar with the humbucker device can be used with both traditional combo amp cabinets and wideband equipment intended, for example, for acoustic guitars. But unlike acoustic guitar, the said guitar, being as an electric, will not require microphones and an additional microphone preamp. This is convenient for live performances and modern record studios computer-based.

Thus, these and other features, aspects and advantages of the present invention will disclosed in the embodiments preferably as active pickups.

BRIEF DESCRIPTION OF THE DRAWINGS

The operation of the invention will become apparent from the following description will more fully taken in conjunction with the drawings, in which.

Figure 1:
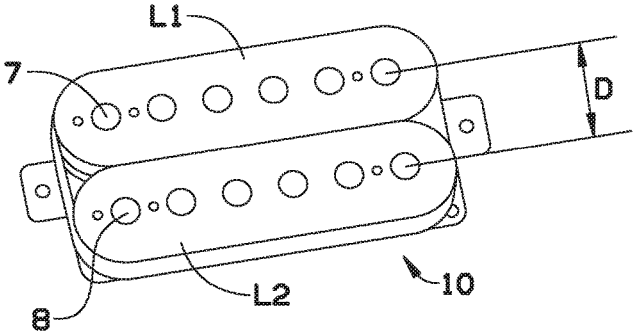
FIG. 1 (PRIOR ART)
FIG. 1 is a perspective view of a conventional two-coil humbucker pickup in its assembled configuration (prior art)

Throughout the figures, the same reference numerals and characters are used, unless new stated, to denote like features, elements, components or portions of the illustrated conventional pickups and embodiments. For convenience, the pickup's coils and bobbins are not shown in some figures since they are not the principal object of the present invention.

DETAILED DESCRIPTION OF THE INVENTION

Broadly, the present invention is an electromagnetic humbucker pickup device for active and passive guitars, where the humbucker device may be used in both the active mode with a preamplifier and the traditional passive mode without the preamplifier (preamp). If the device is used as to ensure switching between the active and passive modes, then a changeover switch needs to be provided outside the humbucker device, i.e. on the body of a guitar.

FIGS. 1, 1A, 1B and 2 illustrate a conventional humbucker 10, a magnetic system of this humbucker and a magnetic system of a conventional single-coil pickup 14 which are generally widely known in the prior art. The operation of these pickups and their magnetic systems, as well as the comparative examples for the magnetic fields apertures of the pickups are presented and described in detail by Beller in U.S. Pat. No. 5,525,750 referenced above.

As is illustrated in FIGS. 3A through 8, the humbucker pickup device for active and passive guitars includes two identical permanent magnets 1 and 2. Each of the magnets 1, 2 in the form of a rectangular bar is an elongated, transversely polarized permanent magnet with a north pole N on one side and a south pole S on the other. Opposite poles of the magnet 1 and the magnet 2 face each other, thereby the magnets are mutually attracted and closely back to back. The magnets 1, 2 may be ceramic or of other magnetic material. The magnets may be of any force, but their forces must be substantially equal to each other as well as their geometrical sizes. In certain embodiments, each of the magnets 1, 2 may be with a cross-section of approximately 7×7 mm and with a length of not less than approximately 50 mm.

Figure 1A:
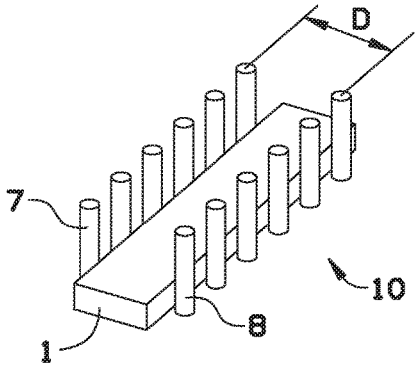
FIG. 1A (PRIOR ART)
FIG. 1A is a perspective view of a magnetic system of the conventional humbucker pickup of FIG. 1 (prior art)
Figure 1B:
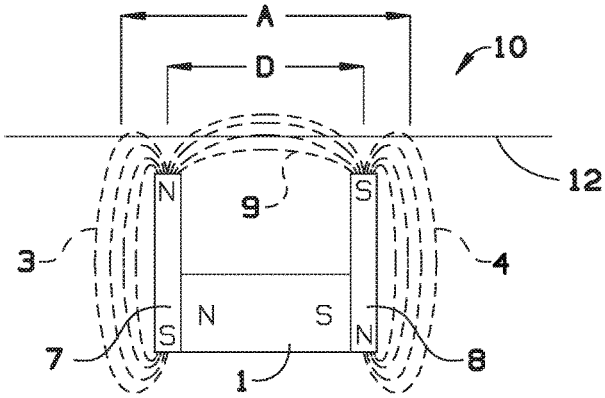
FIG. 1B (PRIOR ART)
FIG. 1B is an elevation view of the magnetic system of the conventional humbucker pickup of FIG. 1A showing the interaction of the magnetic field with the strings above it (prior art)
Figure 2:
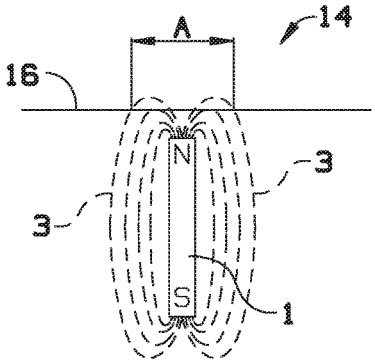
FIG. 2 (PRIOR ART)
FIG. 2 is an elevation view of a magnetic system of a conventional single-coil pickup showing the interaction of the magnetic field with the strings above it (prior art)
Figure 3A:
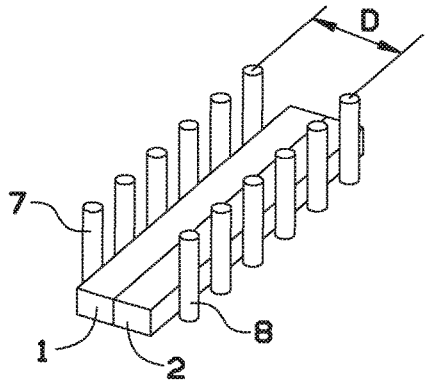
FIG. 3A is a perspective view of an exemplary embodiment of the present invention showing a magnetic system of it.
Figure 3B:
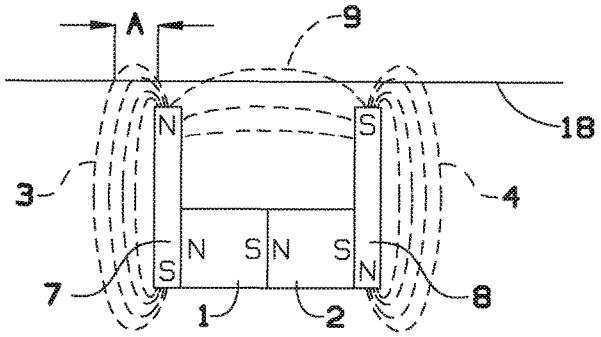
FIG. 3B is an elevation view of an exemplary embodiment of the magnetic system of the humbucker pickup of FIG. 3A showing the interaction of the magnetic field with the strings above it.

FIGS. 3A, 3B illustrate an exemplary embodiment of the present invention (coils, the preamp not shown). To keep the same interval D between two rows of pole pieces, FIG. 3A, equal about 18 mm as in conventional humbuckers, the total width of the magnets 1, 2 is approximately the same as the width of a single magnet 1 in the conventional humbucker 10 (FIGS. 1A, 1B). Thereby, the magnets 1, 2 are located in the humbucker device in the analogous place between the lower ends of pole pieces of the different rows and coils as where the single magnet 1 is positioned in the conventional humbucker 10. The pole pieces of both sets (rows) extend through two coil assemblies (not shown) respectively as that in the conventional humbucker 10. Thus, the general dimensions of the humbucker device are the same as that of any conventional humbucker.

Figure 4A:
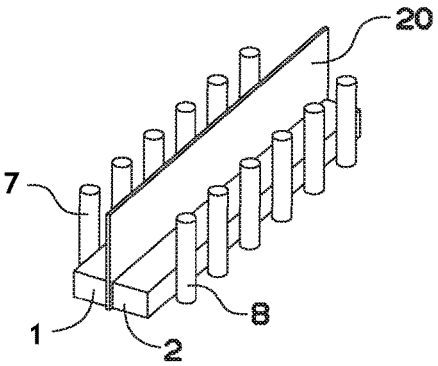
FIG. 4A is a perspective view of an alternate embodiment of the present invention showing a magnetic system of it.
Figure 4B:
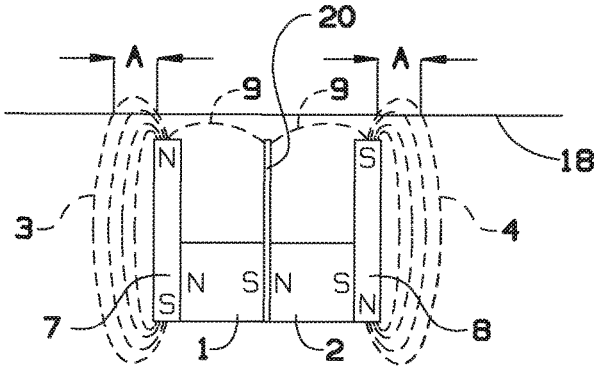
FIG. 4B is an elevation view of an alternate embodiment of the magnetic system of the humbucker pickup of FIG. 4A showing the interaction of the magnetic field with the strings above it.

In certain embodiments, a steel plate 20 may be placed in between the magnets 1, 2 as is shown in FIGS. 4A, 4B illustrating an alternate embodiment of the present invention. The plate 20 may be made of soft iron or the like with the thickness of approximately 0.5-1.0 mm. The plate 20 length may be not less than the length of the magnets 1, 2, and the plate 20 height must be about the same as that for pole pieces in the sets. The pole pieces, made of a ferromagnetic material, may be of any type such as poles, bars, screws or rails instead of the sets of pole pieces (as in rails humbuckers) and the like.

As indicated in the figures for both embodiments (FIGS. 3A, 3B, 4A and 4B), two pole pieces 7, 8 from the different sets may form a pair of pole pieces intended and positioned beneath a respective string 18. Abutting to magnetic poles of the magnets 1, 2, the pole pieces 7, 8, as seen in FIGS. 3B and 4B, have opposite magnetic poles on their upper and lower ends. Thus, under the string 18 the pole pieces 7 and 8 create outer magnetic fields as enough narrow and strong branches 3 and 4, like those branches 3, 4 in the conventional humbucker 10 of FIG. 1B.

Magnetic field apertures A of the branches 3, 4 are shown approximately (FIGS. 3B and 4B) taking into account the images of the magnetic fields of conventional pickups well-known in the art and represented by Beller in his patent noted above. Moreover, it should be understood that the said apertures cannot be wide because perceptible magnetic influence on the string 18 happens in the immediate vicinity to the pole pieces 7, 8. And with moving away from the upper ends of the pole pieces, the magnetic field strength from the branches 3, 4 rapidly decreases along the string. Therefore, it can quite be considered that the magnetic field apertures A of the branches 3, 4 of FIGS. 3B and 4B are enough narrow, each of which, as mentioned above, is twice lesser (even additionally less) than a magnetic field aperture A in the conventional single-coil pickup 14 of FIG. 2. I.e., if the said narrow branches 3, 4 are as the main magnetic fields interacting with the string 18, then the undistorted frequency range for the present invention will be really up to 11520 Hz as calculated above.

Further, the pole pieces 7, 8 and the magnets 1, 2 may create an additional third magnetic field 9 under the same string 18 within the interval D which is the distance between the pole pieces 7, 8 (FIGS. 3A, 3B). As was found for conventional humbuckers, when the two magnets 1, 2 are positioned in accordance with FIG. 3B in the interval D instead of a single magnet, the intermediate magnetic branch 9 becomes weaker so that it can be neglected.

To objectively evaluate the properties of the humbucker device or any other pickup, it is convenient to use the active mode with the preamp built from a differential amplifier. The active mode for a guitar pickup is like a magnifying glass that perfectly shows any advantages or flaws in the signal and tonal quality of this pickup. The improving in tonal quality from the two-magnet system distinctly manifests in the active mode and has allowed the humbucker device easily to be compatible with modern strong magnets and conventional high-impedance coils without additional means of correction. In fact, this confirms that the magnetic branches 3, 4 of FIG. 3B are as the main magnetic fields interacting with the string. While in the conventional humbucker 10 of FIG. 1B, the wide and strong branch 9 cannot be neglected, a rather here it is as the main magnetic field determining tonal quality for this pickup. This is the basic difference between FIGS. 3B and 1B, and between the humbucker device and the conventional humbucker 10 which, as known in the prior art, is practically incompatible with the active mode.

The traditional method of monitoring lines of force (by the iron filings) is not able to objectively describe the magnetic branch 9 between the pole pieces 7, 8 with a glance to guitar/pickup tone. The diagrams by the iron filings in both cases, with the two-magnet system and a single magnet, may be similar. However, if by feel, the difference between the magnetic branch 9 of the two-magnet system (FIG. 3B) and the single magnet 1 (FIG. 1B) is quite obvious from a simple experiment by means of a small steel thing (a needle or a screwdriver) and the fingers. It can be felt that the fingers easily hold the thing in the middle between the pole pieces 7 and 8 (where their upper ends) without any effort in the case of the two magnets 1, 2. For convenience, it is possible to use two steel plates instead of the pole pieces 7, 8 (as in a rail humbucker). While with the single magnet 1 of the conventional humbucker 10, the fingers hold the same thing using a pretty big effort by contrast to the two-magnet system of the device.

In other words, with the two magnets there occurs a failure in the magnetic field strength for the branch 9, mainly, in the middle between the pole pieces 7 and 8. In FIG. 3B this is expressed as a smaller concentration of force lines 9 around the string 18 in the interval D by comparison to FIG. 1B. Apparently, this useful failure occurs thanks to the two inner magnetic poles N and S, by which the magnets 1, 2 are attracted. This variation in magnetic field strength is quite enough for to provide high tonal quality for the humbucker device. The effect from the described two-magnet system was also confirmed on various electric and bass guitars in the process of upgrading conventional humbuckers of various models.

In the alternate embodiment, FIGS. 4A and 4B, the steel plate 20, being between the identical magnets 1, 2, has not a magnetic pole, or at least its pole is weak, much weaker than the magnetic poles of pole pieces 7, 8. I.e., the plate cannot significantly effect on the string vibrations. In tonal quality, thus, this embodiment has no fundamental difference from the exemplary one. Yet, the plate 20 can additionally weaken the magnetic branch 9 near the string 18. The upper edge of the plate may be induced in some degree from the branch 9. Whereby, the plate influences so that the branch 9 is distorted as shown in FIG. 4B where the force line 9 is deflected down to the plate 20 and becomes farther from the string. This little change in the magnetic branch 9 is enough for to use both embodiments of the present invention on a guitar to reduce the sonic defect occurring in the mixed mode from two pickups.

The plate effect for the said mixed mode in guitar may be more noticeable when the humbucker devices of both embodiments, used in Neck and Bridge positions, are similar in components (coils, magnets and preamps). In some cases, the plate 20 can also give a beneficial effect for one humbucker device as a certain improving in high and middle frequencies, in particular, when the device includes coils with a big number of turns. If the plate 20 is 3-4 mm or more farther from the strings than the pole pieces, its effect will quickly decrease.

Figure 5:
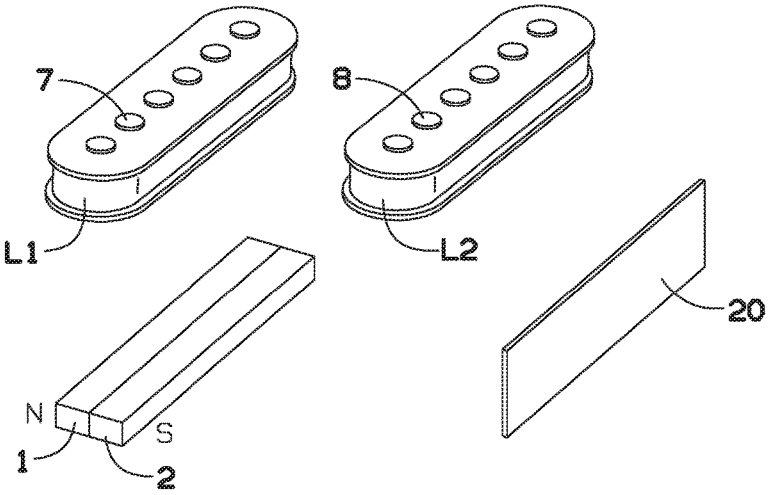
FIG. 5 is an exploded perspective view of structural components including coils of the humbucker pickup of FIGS. 3A and 4A.
Figure 5A:
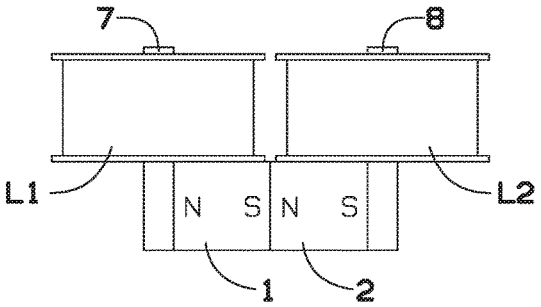
FIG. 5A is an elevation view of the humbucker pickup in its assembled configurations for an exemplary embodiment of the present invention.
Figure 5B:
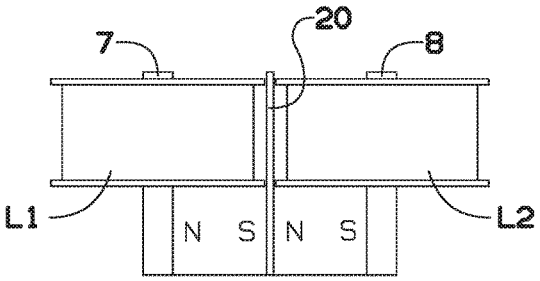
FIG. 5B is an elevation view of the humbucker pickup in its assembled configurations for an alternate embodiment of the present invention.

FIGS. 5, 5A and 5B illustrate components of the present invention including conventional coils L1 and L2 in their separated and assembled configurations for both embodiments. As is seen, with the total width of the magnets 1, 2, the same as that one of a single magnet in conventional humbuckers and owing to the use of the conventional coils L1 and L2, the manufacturing technology surrounding the humbucker device may allow for a similar process as with any conventional humbucker 10, thereby decreasing costs. An upgrade for conventional humbuckers is also possible by replacing a single magnet by the two magnets 1, 2.

The Preamplifier and the Active Mode

A preamplifier of the humbucker device may be built, in particular, on one of the improved differential amplifiers (instrumentation amplifiers) from two or three operational amplifiers, high input impedance of which may be useful to get the full benefit from the humbucker output enriched by the new harmonics.

Figure 6:
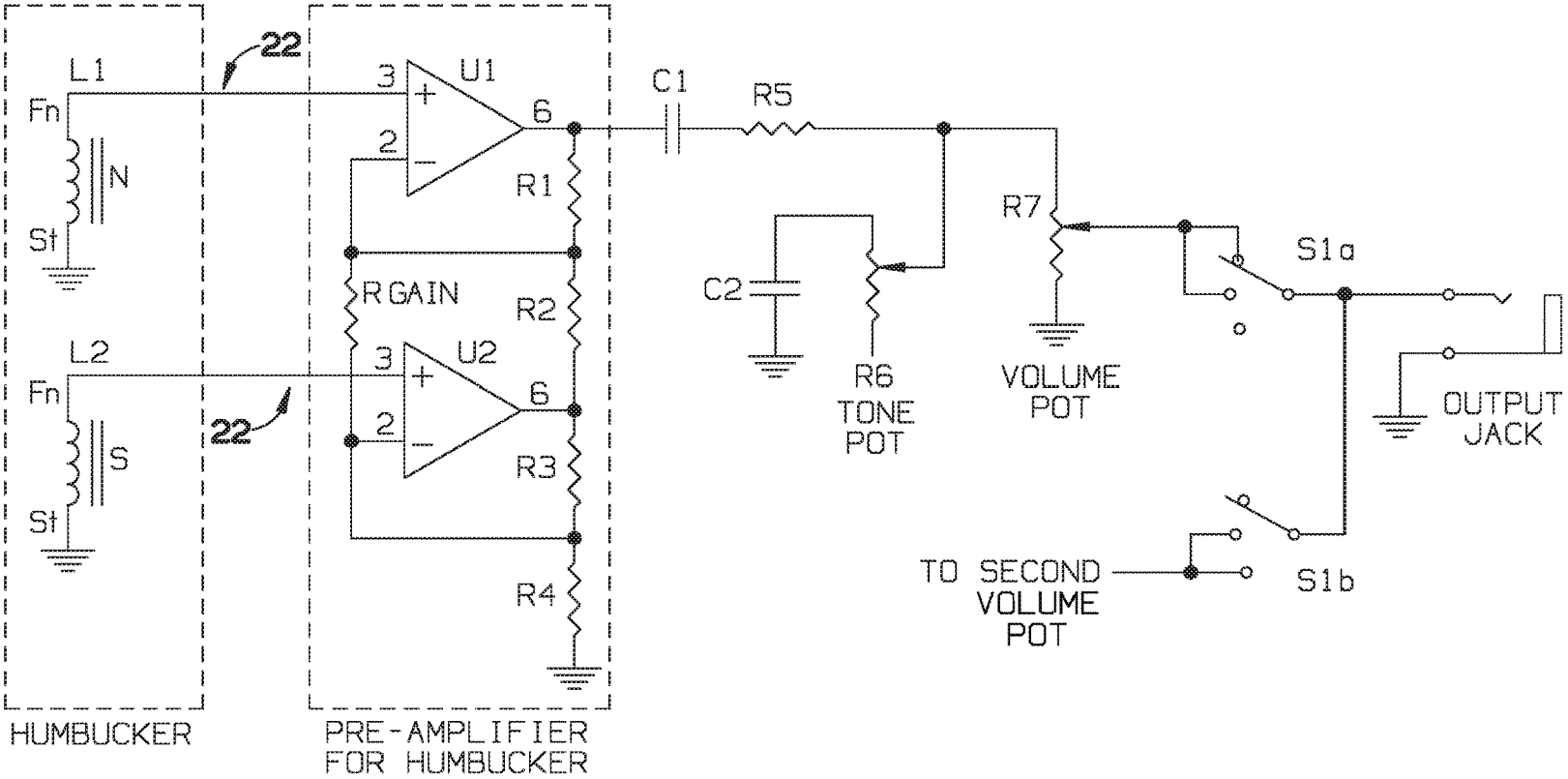
FIG. 6 is a schematic wiring diagram showing the presently preferred embodiment of the present invention in the active mode with a preamplifier.

FIG. 6 illustrates a preferred embodiment of the present invention with a preamplifier (an instrumentation amplifier) built from two operational amplifiers U1 and U2. As is seen, the preamplifier for humbucker may be connected to the two coils L1 and L2 of the humbucker device in the balanced input mode by two differential inputs 22 (the balanced input). In certain embodiments, the coils L1, L2 may be wound in the same direction and be as a matched pair to get the balanced input mode. In this case, the inputs 22 are connected respectively to the finish ends (Fn in FIG. 6) of the coils, and the start ends St of both coils are grounded. Due to opposite magnetic poles on the pole pieces of the different coils, two signals from the coils L1, L2 are electrically of opposite polarities as well. Further these signals are processed by the instrumentation amplifier, circuit and the operation principle of which is well-known to those skilled in the art. Inverting one of the signals, finally the instrumentation amplifier adds up both signals, and noises, which are electrically induced in the coils L1, L2, cancel each other out.

The preferred embodiment in FIG. 6 is shown as a finished electrical system for a two-pickup guitar with two respective volume and two tone potentiometers and a typical 3-way switch S1 of the pickups. The unbalanced output of the preamp is connected to a volume potentiometer R7 through a capacitor C1 and a resistor R5. The resistor R5 must be used if two or more pickups are present on guitar and when mixing the signals from them is possible. A second pickup and guitar components associated with it are not shown. With two humbucker devices on the guitar, accordingly the output of a second preamp is connected to a second volume potentiometer of the guitar in the same manner (through a capacitor and a resistor identical to C1 and R5).

Figure 7:
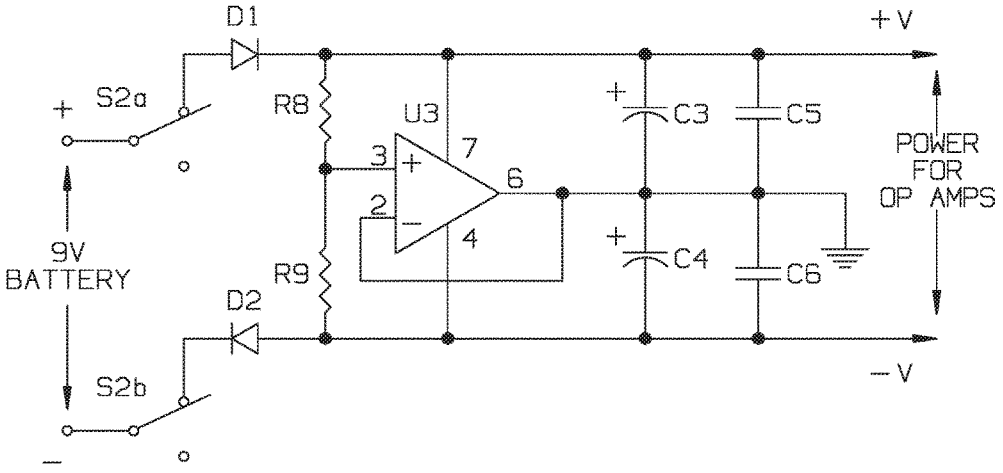
FIG. 7 is a schematic wiring diagram of power supply for operational amplifiers of the preamplifier of the humbucker pickup.

FIG. 7 illustrates a bipolar power supply circuit as one of the possible version of power supply for the preamp. The preamp and its power supply may include operational amplifiers like TL061 (U1, U2 and U3 in FIGS. 6, 7), TL062 (taking into account other leads in the chip) and others. Resistor R5 may be within from 3.3K ohms to 5.6K ohms, the capacitor C1 within from 0.33 uF to 1.0 uF. Tone and volume potentiometers R6, R7 may be roughly 250K ohms. Resistors R8, R9 may be within from 200K ohms to 240K ohms, oxide capacitors C3, C4 from 6.8 uF to 10 uF, capacitors C5, C6 about 0.1 uF.

The power is provided by the 9 Volt power supply like a single 9 Volt battery via a 2-way toggle S2. Sometimes in active guitars for switching on/off the power there may be used an output stereo jack. Here, FIG. 7, the toggle S2 is as an additional toggle on a guitar. It allows the guitar to use the standard output mono jack having longer life. Also, thanks to the bipolar circuit and two diodes D1, D2, the 2-way toggle S2 gives smaller clicks from switching on/off the power.

With high-power coils (not less 5,000 turns per coil) and modern strong magnets used in the humbucker device, the preamp may be made as a separate component and, as mentioned, be mounted inside the volume/tone section in guitar. Such option is probably more suitable for guitar manufacturers. If both active and passive modes are required for a guitar, the changeover switch of the modes must be preferably near the preamp.

With conventional coils and modern strong magnets, the gain of the preamp may be within from 1 up to 2, accordingly with a larger value for the humbucker device in Bridge position on a guitar. Such gain will allow the guitar output to be in accordance with typical equipment as guitar combo amp cabinets, effect boxes, also, home HI-FI preamps/amplifiers and the like. With two humbucker devices on guitar, setting of the signal level from Neck, Bridge devices is fulfilled by resistors R-GAIN in their preamps, FIG. 6, in the following way that should be understood by those skilled in the art. For example, with identical resistors R1=R2=R3=R4 equaling 10K ohms in both preamps, at first a resistor R-GAIN of Neck humbucker's preamp is set and fixed within from 300K ohms to 500K ohms, or this resistor may be absent. Next, a similar resistor R-GAIN in Bridge humbucker's preamp is chosen from approximately 33K ohms to 62K ohms or more so, to adjust and to fix the output level of the Bridge device in accordance with the Neck device output. For convenience, one the said R-GAIN resistors may be as a trimming resistor.

With a glance to the experience of passive pickups, in particular, to avoid a harshness in the sound of an electric guitar, that is described in the Blucher et al. U.S. Pat. No. 5,908,998 noted above, it can be done in a simple way also due to the preamp with the R-GAIN resistor. Most often the harshness problem occurs for pickups in Bridge position. Solving this problem by coils of high inductance with a larger number of turns, with which the harshness disappears, the signal levels of Neck/Bridge humbucker devices are adjusted in the similar way as described above by a gain resistor in one of the preamps.

With coils of a big number of turns (more 6,000 per coil) and modern strong magnets, for example, ceramic, the signal level of the humbucker device may be too large even with the minimal gain of the preamp. This can cause undesirable feedback from any nearby speakers, which are usually present around guitar players. In this case, to save the said coils unchanged, the total magnetic field of the humbucker device should be loosened to avoid said feedback, for example, by reducing the sizes of the magnets. For said ceramic magnets, as pretty strong, it will be better if their sizes are diminished to 5×5 mm in cross-section. To save the conventional interval 18 mm between respective pole pieces with closely adjoining to them magnets, said diminished magnets may be mounted with a certain gap between their inner North/South pole surfaces, and the gap may be filled by a plastic or other dielectric material. Such a design with said gap retains the same tonal properties of the device.

Despite the narrow apertures A of the magnetic fields 3, 4 (FIGS. 3B, 4B) the signal from the coils in the humbucker device is not weaker than a signal in the conventional humbucker 10 (FIG. 1B) with the same coils. I.e., the humbucker pickup of the present invention may be quite used as a passive version without the preamp. In this case, having opposite magnetic polarities, the coils L1 and L2 must be connected in out-of-phase to each other (this case not shown) as in conventional humbuckers. However it should be noted that a guitar with such humbucker without the preamp will lose the ability to be used with various wideband equipment.

Guitar Equipment for Electric Guitar with the Humbucker Device

As mentioned above, an electric guitar comprising the humbucker device may be used with equipment not associated with electric guitars. This may be a studio mixer or usual Hi-Fi pre/amplifier, or amplifiers and loudspeakers intended for acoustic guitar or vocals etc. With humbucker device's preamp the guitar will be matched for impedance to the said equipment. But besides, using the active mode and the said equipment, the humbucker device can provide for the electric guitar a pleasing and natural tone, and in certain cases in music such guitar can replace acoustic guitar. On a whole, what equipment should be used, wideband or traditional for electric guitars, for the guitar with the present invention this is not matter much.

In particular, with wideband equipment it may be enough to have an amplifier with a 3-4-bands equalizer. With some loudspeakers, usual home Hi-Fi pre/amplifier can also be sufficient to get a good guitar tone. And the signal from this preamplifier may be used for recording at a home studio computer-based without the need for additional processing by so-called a reamp method using studio guitar equipment. Perhaps, for some heavy musical styles the traditional guitar equipment like combo amp cabinets, effects boxes will remain preferable, but that will not be as the general rule for other music styles if a guitar includes the humbucker device. I.e., the effects boxes or other devices for tonal coloring and harmonic saturation may be useful for the guitar with the invention, but are not necessary.

Figure 8:
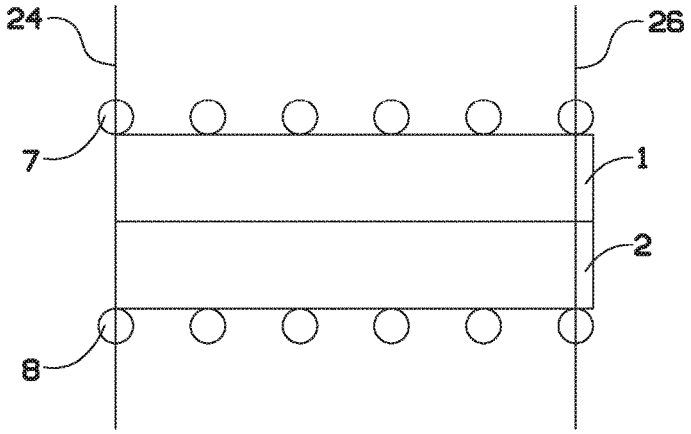
FIG. 8 illustrates one of the possible dispositions of magnets inside the humbucker pickup relative to the pole pieces adjacent the sixth string to reduce an excess of low frequencies from the string in some guitars for the case of the magnets of big force.

FIG. 8 illustrates one of the possible dispositions of the two magnets 1, 2 inside the humbucker device relative to pole pieces associated with the sixth string 24. Such disposition is not typical and, as a rule, not required for the device. In rare case for some guitars with the use of wideband equipment and with strong magnets in the device, some excess of low frequencies may be noticeable a little from the sixth string 24. The shown disposition may reduce the said excess in the lows while retaining the strong magnets.

For fans of pickups with an increased number of turns like P90 pickups, a similar sound can be obtained by means of the device and the coils L1, L2 also with an increased number of turns (from approximately 5,000 turns per coil and more). The humbucker device cannot repeat fully a single-coil pickup in sound because the device picks up the string signal from two points, however thanks to this, its tone may be even more beautiful and saturated.

There are many electric guitars made of expensive types of wood. The use of the humbucker device on different guitars has shown that cheap guitars made of cheap wood and even guitars not made of wood, for example, made of the pressed cardboard or plastic and the like, can also provide a quality sound and tone, mainly in the active mode. The difference in the sound between expensive guitars made of expensive wood and cheap guitars of cheap wood becomes less if these guitars have the invention.

Referring back to the passive mode, it can be added that without the preamp the humbucker of the invention becomes more like a conventional humbucker. The effect from the invention (from the two-magnet system) in this mode may be little appreciable. As is known, the signal of passive pickups is too dependent on various factors including the length of the guitar cable, and the tonal properties of the pickups and guitars are also dependent on the guitar equipment. These features are rather as drawbacks of the passive pickups therefore the active mode with the preamp is particularly preferable for the invention. In this case the invention has fully the advantages of both passive and active pickups, while not having their disadvantages.

Additional advantages and other modifications will occur to those skilled in the art such as using different versions of the preamp, other types of pole pieces and coils etc. These modifications may be made without departing from the spirit and scope of the invention as set forth in the following claims.

What is claimed is:

1. In a humbucker pickup device for active and passive guitars including a matched pair of elongated coil assemblies placed closely in parallel, two sets of ferromagnetic pole pieces extending through said coil assemblies, one set for each coil, in which said pole pieces having the upper ends disposed adjacent ferrous strings of a guitar so that each string is over two respective pole pieces, one from each set, an improvement for the interaction of the magnetic field with a string at two points, comprising: two transversely polarized permanent magnets, each in the form of an elongated bar having a rectangular cross-section and opposed longitudinal surfaces constituting pole faces, north and south respectively, said north pole surface of one magnet and south pole surface of the other magnet facing each other, attracting said magnets closely back to back; said magnets disposed below both of said cods and between said two sets of pole pieces, wherein two other, outer pole surfaces of said magnets also with opposite poles engage to the lower ends of pole pieces of a first and a second sets respectively, inducing opposite poles on said two respective pole pieces under each string and thereby providing opposite magnetic polarities for said coils wounded in the same direction; said two respective pole pieces providing a wide intermediate magnetic field between them weakened near a string and two outer narrow more strong magnetic fields applied to said string, with said two magnets having the opposite north/south poles in the middle between said two respective pole pieces there is a decrease in intensity of said wide intermediate magnetic field near the string, thereby the string is more free in its vibrations providing an improved string signal picked up at two points by said narrow magnetic fields.

2. The humbucker pickup device in claim 1, wherein said two cons have two end wires, one from each coil, electrically connected to ground terminal of the humbucker device such that said coils are electrically in same polarity, and two other end wires of said coils are as two output ends of humbucker pickup means for converting said improved string signal into electrical pickup signals and for providing said electrical pickup signals including in-phase externally generated noise signals across said two output ends.

3. The humbucker pickup device of claim 2 further comprising a differential amplifier having inverting and noninverting input terminals which are electrically connected to said two output ends of the humbucker pickup means so that said differential amplifier provides effective canceling said external in-phase noise signals, while with said opposite magnetic polarities in the coils the music signals magnetically created in the cons are added providing an output pickup signal free from said noise.

4. The humbucker pickup device in claim 3, wherein said differential amplifier is an instrumentation amplifier having high input impedances and a single gain-resistor for adjusting the level of said output pickup signal.

5. The humbucker pickup device in claim 4, wherein said humbucker pickup means, comprising said two magnets and said coil assemblies with the sets of pole pieces, and said instrumentation amplifier are mounted on a common pickup support member.

6. The humbucker pickup device in claim 4, wherein for the matched pair of coils said instrumentation amplifier allows to use high impedance coils with a big number of turns from 5,000 up to 8,000 turns per coil, and wherein said gain-resistor of said instrumentation amplifier is adjustably seated by a predetermined value and is selected to establish said output pickup signal of desired level providing for the humbucker device to be used in any position on the guitar.

7. The humbucker pickup device in claim 6, wherein the coil assembles with the sets of pole pieces and said two magnets are mounted on a common pickup support member wherein the coil assembles include said high impedance coils with the big number of turns from 5,000 up to 8,000 turns per coil, and said two magnets are made of magnetic ceramics that is used in magnets of said conventional passive humbuckers, while the instrumentation amplifier is mounted separately inside a tone-volume section of the guitar.

8. The humbucker pickup device of claim 3, further additionally comprising: a ferromagnetic plate having the thickness between 0.5 mm and 1.0 mm and the length, at least not less than the length of the magnets, positioned between the magnets and the coils, said plate directed to the strings has the height such that its upper edge is roughly at the same distance from the strings as the upper ends of the pole pieces, where under each string said upper edge of the plate induced by said wide intermediate magnetic field additionally distorts and weakens said intermediate magnetic field thereby improving string signal.

9. The humbucker pickup device in claim 8, wherein the humbucker pickup means, the instrumentation amplifier and said ferromagnetic plate are mounted on a common pickup support member.

10. The humbucker pickup device in claim 8, wherein said ferromagnetic plate, the two magnets and the coil assemblies with the sets of pole pieces are mounted on a common pickup support member without the instrumentation amplifier wherein the coil assembles include high impedance coils with a big number of turns from 5,000 to 8,000 turns per coil, and said two magnets are made of magnetic ceramics that is used in magnets of said conventional passive humbuckers, and wherein the instrumentation amplifier is mounted, thus, separately inside the tone-volume section of the guitar.

11. The humbucker pickup device in claim 3, wherein the total width of said two magnets, the distance between their outer pole surfaces, is the same as the width of a single magnet used in said conventional passive humbuckers, in which the single magnet disposed in the similar place between two sets of pole pieces has the width from 12.5 mm to 14 mm.

12. The humbucker pickup device in claim 11, wherein said two magnets may be made of any permanent magnet material of any magnetic force, magnetic ceramics or alnico material, wherein said two magnets must be equal in their sizes and magnetic forces.

13. The humbucker pickup device in claim 12, wherein with said two equal magnets the wide intermediate magnetic field is weaker than the analogous wide intermediate magnetic field in passive humbuckers with said single magnet of the same width as the total width of said two magnets, providing, thereby, improved tonal properties for the device and the guitar.

14. The humbucker pickup device in claim 13, wherein with said equal magnets and improved tonal properties, with high impedance coils with a big number of turns from 5,000 up to 8,000 turns per coil and in the case of using an instrumentation amplifier any additional filters or equalizers inside pickup or guitar body.

* * * * *